US007862399B1

(12) United States Patent
Culpepper

(10) Patent No.: US 7,862,399 B1
(45) Date of Patent: Jan. 4, 2011

(54) ARMATURE KIT AND CONSTRUCTION

(76) Inventor: Scott Culpepper, 904 E. Walnut St., Lebanon, IN (US) 46052

( * ) Notice: Subject to any disclaimer, the term of this patent is extended or adjusted under 35 U.S.C. 154(b) by 0 days.

(21) Appl. No.: 10/245,269

(22) Filed: Sep. 17, 2002

(51) Int. Cl.
*A63H 3/04* (2006.01)

(52) U.S. Cl. ..... 446/374; 446/375; 446/383; 206/575; 434/82

(58) Field of Classification Search ..... 446/87, 446/97, 102, 373, 374, 375, 376, 383; 434/82; 206/575, 579
See application file for complete search history.

(56) References Cited

U.S. PATENT DOCUMENTS 4,932,919 A * 6/1990 Shapero ..... 446/374
5,630,745 A * 5/1997 Yeh ..... 446/374
5,897,417 A * 4/1999 Grey ..... 446/125

* cited by examiner

*Primary Examiner*—Jacob K. Ackun, Jr.
(74) *Attorney, Agent, or Firm*—Woodard, Emhardt, Moriart, McNett & Henry, LLP

(57) ABSTRACT

Described are novel armature kits, constructions and elements, providing increased flexibility in design and ease of use. In one aspect, inventive armatures include adaptations to isolate the tensioning of ball-and-socket joints occurring at either end of a motion segment. In other aspects, inventive armatures and kits include uniquely shaped plates, providing interchangeability among chest and hip areas of a human form. Novel threaded and tie-down armature elements are also described.

21 Claims, 11 Drawing Sheets

ARMATURE KIT AND CONSTRUCTION

BACKGROUND

The present invention relates generally to armatures. In particular, the present invention relates to ball-and-socket armature kits, constructions, and elements that incorporate novel features providing flexibility in armature design and ease in construction and use.

As further background, armatures of varying construction are known. Armatures have been made of rods, wires, tubes, and plates, combined to erect rigid or movable frameworks of various sizes. In one general field of endeavor, armatures have been constructed primarily of wires that are bent or formed into various shapes. For example, U.S. Pat. No. 4,674,981 discloses wires fashioned into selected shapes to form a modeling armature. U.S. Pat. No. 3,395,484 discloses an internal wire skeleton formed in the shape of a doll. U.S. Pat. No. 2,545,210 describes a wire frame armature erected and supported by a perpendicular post inserted in an armature collar socket. U.S. Pat. No. 2,109,422 discloses a lead wire figure that can be bent to form a puppet, doll or toy animal and receive conforming textile material.

Ball-and-socket armatures are also known, and typically are constructed from plates of various size intended to represent segments of the figure to be created. The plates have apertures or dimples to provide sockets to receive ball elements of dumbbell-type connectors. The ball elements are sandwiched between two plates that are held in tension by a connector such as a screw. A number of adaptations are then available to form specific appendages such as feet, hands, or heads. Kits for such ball-and-socket armatures are available, for example, from Armaverse, Inc., Indianapolis, Ind., under the tradenames Humature (human form) and Armasaur (dinosaur form).

Needs exist for armature kits and constructions having greater design flexibility and that are readily manufactured and used. Additionally, needs exist for armature elements that provide the ability to incorporate novel armature geometries and configurations, and ease of use. The present invention addresses these needs.

SUMMARY OF THE INVENTION

Accordingly, in one aspect, the present invention provides an armature including an armature body having a first segment including at least two plates. The plates each define at least two joint sockets for receiving ends of dumbbell connectors to create ball-and-socket joints, wherein the joint sockets of the respective plates form pairs laterally aligned with one another. The body also includes at least two dumbbell connectors, each having an end received within one of said pairs of joint sockets to create a ball-and-socket joint. The plates each define fastener-receiving apertures adjacent each socket, and are laterally connected to one another with fasteners positioned through the fastener-receiving apertures. The plates each further define an isolator socket between the fastener-receiving apertures, for receiving a joint isolation component, such as a ball or spacer. The isolator sockets of the plates are laterally aligned with one another, and a joint isolation component is received and sandwiched between the isolator sockets so as to provide isolated tensioning of the ball-and-socket joints.

In another embodiment, the invention provides an armature kit including a plurality of plates each of a first length, the plates having apertures in corresponding locations along their length, whereby the apertures are aligned when the plates are positioned laterally to one another. The kit also includes a plurality of plates each of a second length, these plates also having apertures in corresponding locations along their length, whereby the apertures are aligned when the plates are positioned laterally to one another. The kit includes a plurality of dumbbell connectors of a first length, the connectors having a first spherical element, a second spherical element, and an intermediate post connecting said first and second spherical elements, and a plurality of dumbbell connectors of a second length, these latter connectors also having a first spherical element, a second spherical element, and an intermediate post portion connecting the first and second spherical elements. A plurality of ball elements are included in the kit, and have substantially the same diameter as the spherical elements of the connectors. The kit further includes a plurality of fasteners, and a plurality of diamond plates. The diamond plates have a generally non-equilateral deltoid shape having a wider end and a narrower end, and a plurality of apertures defined therein.

Still another embodiment of the invention provides an armature kit that includes (a) a plurality of first plates each of a first length, the first plates each defining apertures in corresponding locations along their length, whereby the apertures are aligned when the plates are positioned laterally to one another. The apertures in each first plate include two joint apertures for use in forming ball-and-socket joints, wherein the joint apertures are located adjacent opposite ends of the first plate. The apertures also include two fastener apertures for receiving fasteners, and at least one isolator aperture for receiving an isolator component. The isolator aperture is located between the fastener apertures, so as to effectively isolate the tensioning of respective fasteners when received through the fastener apertures. The kit also includes (b) a plurality of first dumbbell connectors having ends receivable in the joint apertures of the plates, to form ball-and-socket joints; (c) a plurality of fasteners receivable in the fastener apertures; and (d) a least one isolator component, such as a ball element, receivable in said isolator aperture.

The present invention also includes a number of novel components for incorporation into armatures, and armatures and armature kits including such components. One such component is a dumbbell connector having a first spherical element, a second spherical element, and an intermediate portion connecting the first and said second spherical elements, wherein a threaded aperture, optionally a thru-aperture, is included in at least one of said spherical elements. The threaded aperture can have an axis transverse (including perpendicular) to that of an intermediate rod element of the connector, or generally aligned or parallel thereto. Another such component is a tie-down connector including a generally spherical end portion, a collar (preferably cylindrical), and an intermediate portion connecting the end portion and collar. The collar has a threaded aperture defined therein. Another such component is a ball element having a threaded thru-aperture. Still another such component is a diamond plate having a generally non-equilateral deltoid shape having a wider end and a narrower end, and having a plurality of apertures defined therein. Illustratively, such diamond plates can be used for chest, torso, or hip portions of creature-form armatures. Each of these components can be combined alone or together with other conventional components of armature kits, including for example plates (including plates of varying lengths), dumbbell connectors (including dumbbell connectors of varying length), fasteners, ball elements, threaded rods, and the like, to form additional embodiments of the present invention.

Additional embodiments as well as features and advantages of the invention will be apparent from the further descriptions and drawings herein.

DESCRIPTION OF THE PREFERRED EMBODIMENTS

Figure 1:
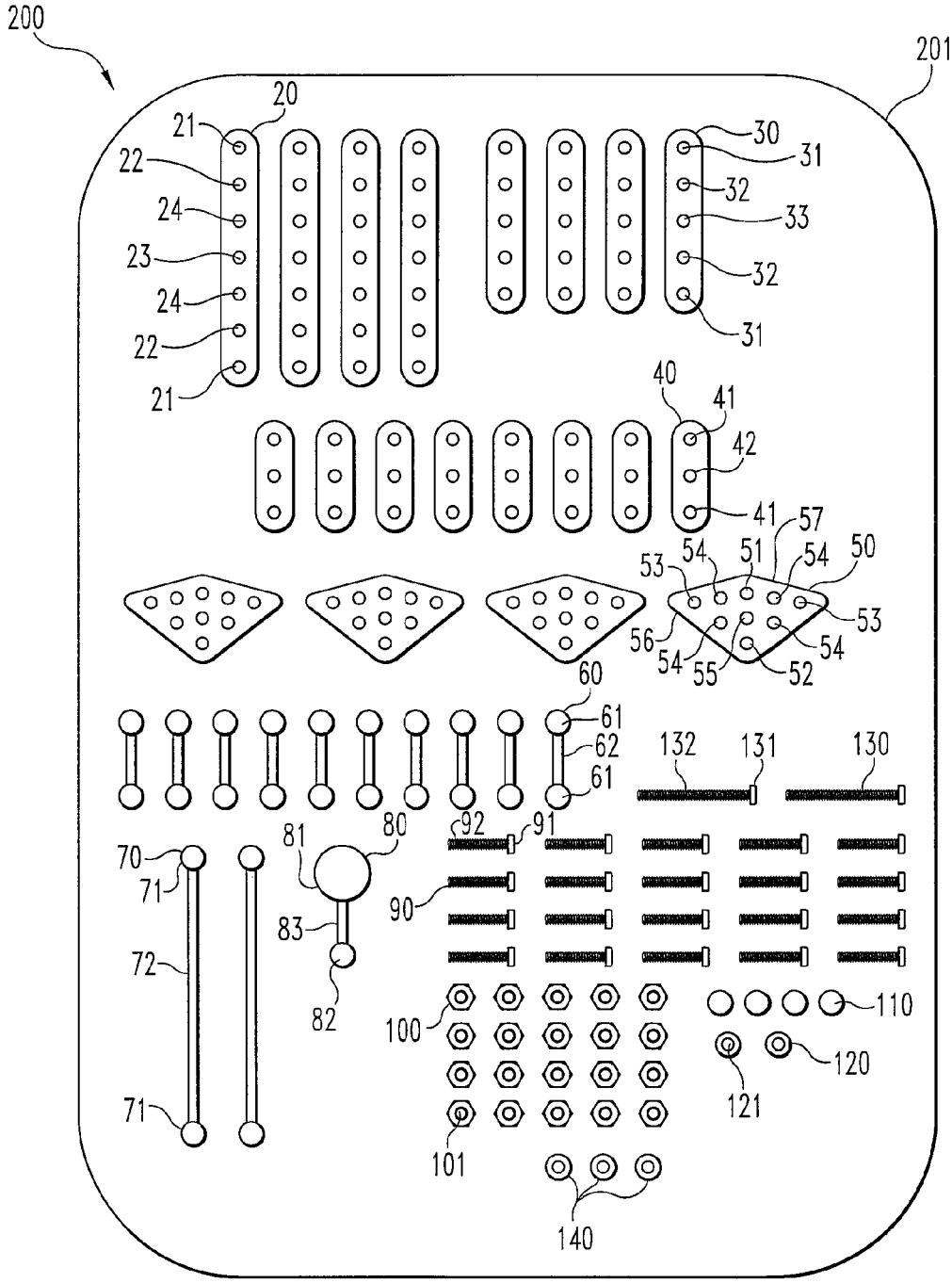
FIG. 1 depicts an armature kit of the invention.

For the purpose of promoting an understanding of the principles of the present invention, reference will now be made to the embodiment illustrated in the drawings and specific language will be used to describe the same. It will, nevertheless, be understood that no limitation of the scope of the invention is thereby, intended; any alterations and further modifications of the described or illustrated embodiments, and any further applications of the principles of the invention as illustrated therein are contemplated as would normally occur to one skilled in the art to which the invention relates.

With reference now to FIG. 1, shown is an armature kit 200 in accordance with the invention. Armature kit 200 has a bag, box, or other container 201 containing a number of elements in the armature kit. These elements include a plurality of relatively long plates 20. The long plates 20 include seven apertures, although fewer or more can be incorporated within the spirit and scope of certain aspects of the invention. The depicted long plates 20 include apertures 21 adjacent each end of the plate 20, and a plurality of additional apertures located therebetween. In certain armature forms, the end apertures effectively provide the sockets for ball-and-socket arrangements. The additional apertures include apertures 22 positioned inwardly from and adjacent to end apertures 21. Also included is a generally centrally located aperture 23, and apertures 24 positioned on either side of the central aperture 23. As discussed and illustrated further below, the apertures 22-24 can be used to serve multiple purposes in the construction of armatures, for example serving as connector or fastener-receiving apertures, or serving to receive ball or spacer elements that provide rigidity and stability to motion segments and/or serving as isolater elements to provide independent tensioning of the sandwiched ball-and-socket joints on each end of a motion segment.

The preferred armature kit 200 further includes intermediate-length plates 30. Intermediate plates 30 each include five apertures in the illustrated embodiment. These include end apertures 31, a central aperture 33, and intermediate apertures 32 located between end apertures 31 and central aperture 33. Further included in the preferred kit are relatively short plates 40 each having three apertures. Short plates 40 each include end apertures 41 and a central aperture 42.

Kit 200 further includes a plurality of body plates 50 having a generally diamond shape. Plate 50 is a multi-sided plate including a plurality of apertures 51 through 55 for receiving and cooperating with surrounding elements of the armature. More specifically, plate 50 in the illustrated embodiment is tetragonal in shape, and provides a generally non-equilateral deltoid shape, with rounded corners. Thus, plate 50 includes two generally longer sides 56 of equal length, and two generally shorter sides 57 of equal length, giving the plate the overall appearance of a diamond. This shape and aperture configuration of the preferred body plate 50 allows its use interchangeably as either the hip/lower back or the shoulder/chest portions of animals such as humans, while approximating anatomically correct dimensions. The outermost laterally-spaced apertures 53 can, for example, be used for attachment of arm or leg elements, and the outermost vertically spaced apertures 51 and 52 can be used for attachment of neck/head elements and thorax/spine elements, respectively. The remaining apertures 54 and 55 can be used for connectors, balls, spacers, or dumbbell attachments, if desired.

Armature kit 200 also includes a plurality of relatively short dumbbell connectors 60. Short dumbbell connectors 60 each include generally ball-shaped or spherical end portions 61, connected to one another by an intermediate post portion 62. Short dumbbell connectors 60 are of a length suitable to provide a close but pivotal connection between adjacent armature segments. Kit 200 further includes long dumbbell connectors 70. Long dumbbell connectors 70 similarly include generally ball-shaped or spherical ends 71, connected by an intermediate post portion 72. Long dumbbell connectors are of a length that typically lends application to use to represent all or a portion of a long appendage, such as representing the portion of a human leg occurring below the knee. The preferred kit 200 further includes a dumbbell 80 having a spherical end portions of differing size or diameter, e.g. having a relatively larger spherical portion 81, and a relatively smaller spherical end portion 82, connected by an intermediate post 83. At least one of the end portions, e.g. end portion 82, is sized for receipt within the apertures of the various armature plates in the kits as described above. The other end portion, e.g. 81, is useful to represent the head of the armature, for example, when creating a human form. Alternatively, the other end portion 81 can be sized for receipt within plates of a different size, e.g. larger plates having larger sockets (dimples or apertures), so as to enable the integration of armature elements of differing size.

Kit 200 further includes a plurality of screws 90 having heads 91 and threaded portions 92, and a plurality of nuts 100 having threaded apertures 101 for threaded engagement with threaded portions 92 of screws 90. The preferred kit also includes a plurality of balls, such as ball bearings 110, and a plurality of balls 120 having apertures 121 therein, with apertures 121 containing threads for threadable engagement with the threaded portions of screws 90. Balls 110 can, for example, be received and sandwiched between plates to provide relatively independent tensioning of opposing ball-and-socket joints as discussed further below. Additional armature kit elements may also be included, for example additional hardware elements such as lockwashers, spacers, etc.

Figure 2:
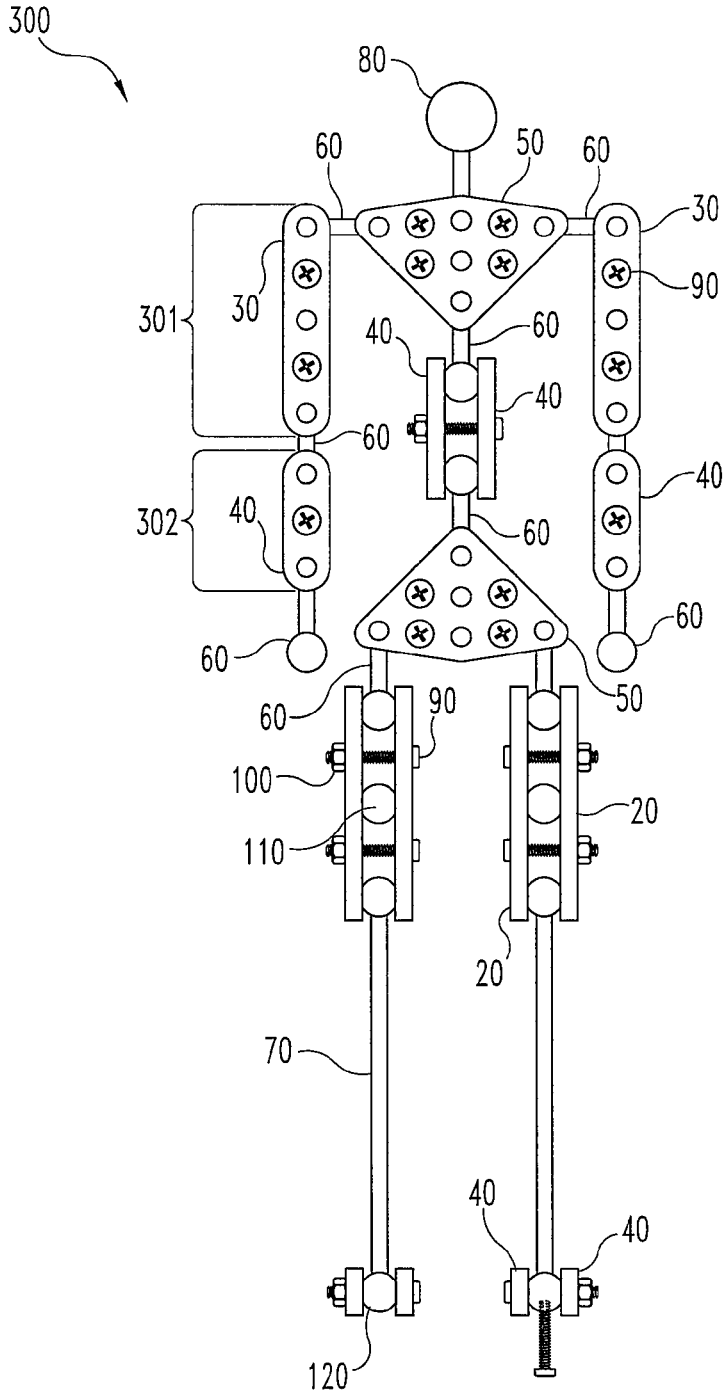
FIG. 2 depicts an armature of the invention having a generally human form.

With reference now to FIG. 2, shown is a human-form armature construction 300. Armature 300 includes a head/neck element formed from dumbbell element 80, and a chest portion formed from two diamond plates 50 interconnected by a plurality of screw/nut combinations as shown. In particular, in the illustrated embodiment, screw/nut combinations are provided in corresponding apertures 54 of the two diamond plates 50, while a ball bearing 110 is sandwiched between the aligned central apertures 55. The smaller end portion 82 of dumbbell element 80 is sandwiched between the uppermost apertures 51 of these diamond plates 50. The remaining aperture pairs of the aligned diamond plates 50 are dedicated to dumbbell connectors extending to other body segments as discussed further below.

Armature 300 further includes arm portions connected to the chest portion by dumbbell connectors 60. Arm portions include a first, longer motion segment 301 and a second, shorter motion segment 302. Segment 301 is formed by two intermediate plates 30 connected by screws and nuts as shown, and sandwiching a ball element of a dumbbell connector 60 on each end. Specifically, screw/nut combinations are provided in the aligned apertures 32 of the two intermediate plates 30, and a ball bearing 110 is sandwiched between the central apertures 33 of the two intermediate plates 30. In this regard, the ball bearing 110, being sandwiched in between the screw/nut combinations on either side, enables the independent tensioning of the ball-and-socket joints formed by the sandwiched dumbbell connector elements on each end. That is, tightening or loosening a first of these screw/nut combinations in order to adjust the tension of the adjacent pivotal ball-and-socket joint will not have a significant effect upon the tension of the opposite ball-and-socket joint. This can provide considerable benefit in the construction and adjustment of the armature, as the delicate process of alternate tightening of the two screws that would be necessary absent the joint isolation is removed or significantly reduced.

Second arm portion 302 is formed by two short plates 40 connected by a screw/nut combination as shown, and on each end sandwiching a spherical end element of a dumbbell connector 60. As shown, the upper element of dumbbell connector 60 interconnects the first arm portion 301 and the second arm portion 302. The lower dumbbell portion 60 has an end left freestanding, generally representing a hand of the armature 300.

The thorax of the armature 30 is formed by two plates 40 interconnected by a screw/nut combination received within central apertures 42, and on each end sandwiching a spherical end portion of a dumbbell connector 60 within the end apertures 41 of the plate 40. The upper dumbbell element within this structure has its other end sandwiched between the plates 50 of the chest portion of the armature, in particular sandwiched in between lowermost apertures 52 of the respective diamond plates 50. The lower dumbbell connector 60 in the structure has its opposite end portion sandwiched between two additional plates 50 forming the hip portion of the armature 300, and in particular in the aligned apertures 52 of the plates 50. As illustrated, the plates 50 forming the hip structure are inverted relative to the plates 50 forming the chest structure. Plates 50 forming the hip structure are similarly interconnected by four screw/nut combinations received within apertures 53, as shown. The central aperture 55 and the aperture 51 of the diamond plates 50 in the hip portion of the armature can each sandwich a ball bearing to improve the overall stability of the structure.

The armature 300 also has leg portions. Each leg portion begins with a dumbbell connector 60 having one end thereof sandwiched between apertures 53 of diamond plates 50 of the hip portion. The opposite spherical end portion of the connector 60 is sandwiched between the relatively long plates 20 of the armature kit, and in particular between the end apertures 21 of two such plates 20. The two plates 20 are interconnected by two screw/nut combinations received within the aligned apertures 22, as shown. A ball bearing 110 is sandwiched between the central apertures 23 of the plates 20. Again, ball bearing 110 sandwiched between the fasteners serves not only to add stability to the overall leg structure, but also to facilitate independent tensioning of the sandwiched ball-and-socket joints at the upper and lower ends of this motion segment of the leg. Centrally located ball bearing 110 thus facilitates the appropriate and, if desired, differential tensioning of the sandwich ball joints at each end of this segment. The opposite (lower) end apertures 21 of the plates 20 sandwich a spherical element of a relatively longer connector 70 forming the lower leg portion of the armature 300.

At the lower end of this dumbbell connector 70, the spherical portion is sandwiched between two of the short plates 40, and in particular is received within the central apertures 42 of the plates 40. The plates 40 generally represent foot structures, and are held together on each end by screw/nut combinations received through end apertures 41.

With continued reference to FIG. 2, shown as another feature of the invention in which a relatively long dumbbell connector 70 has an aperture 120 in at least one end thereof, and having threads within the aperture for threadable mating with the bolts 90. The central axis of aperture 120 is generally aligned with the axis of the intermediate post 72 of the connector 70. In this fashion, dumbbell connector 70 can be utilized as a tie-down mechanism to attach the armature 300 to an underlying surface through which a screw 90 is passed.

Figure 3:
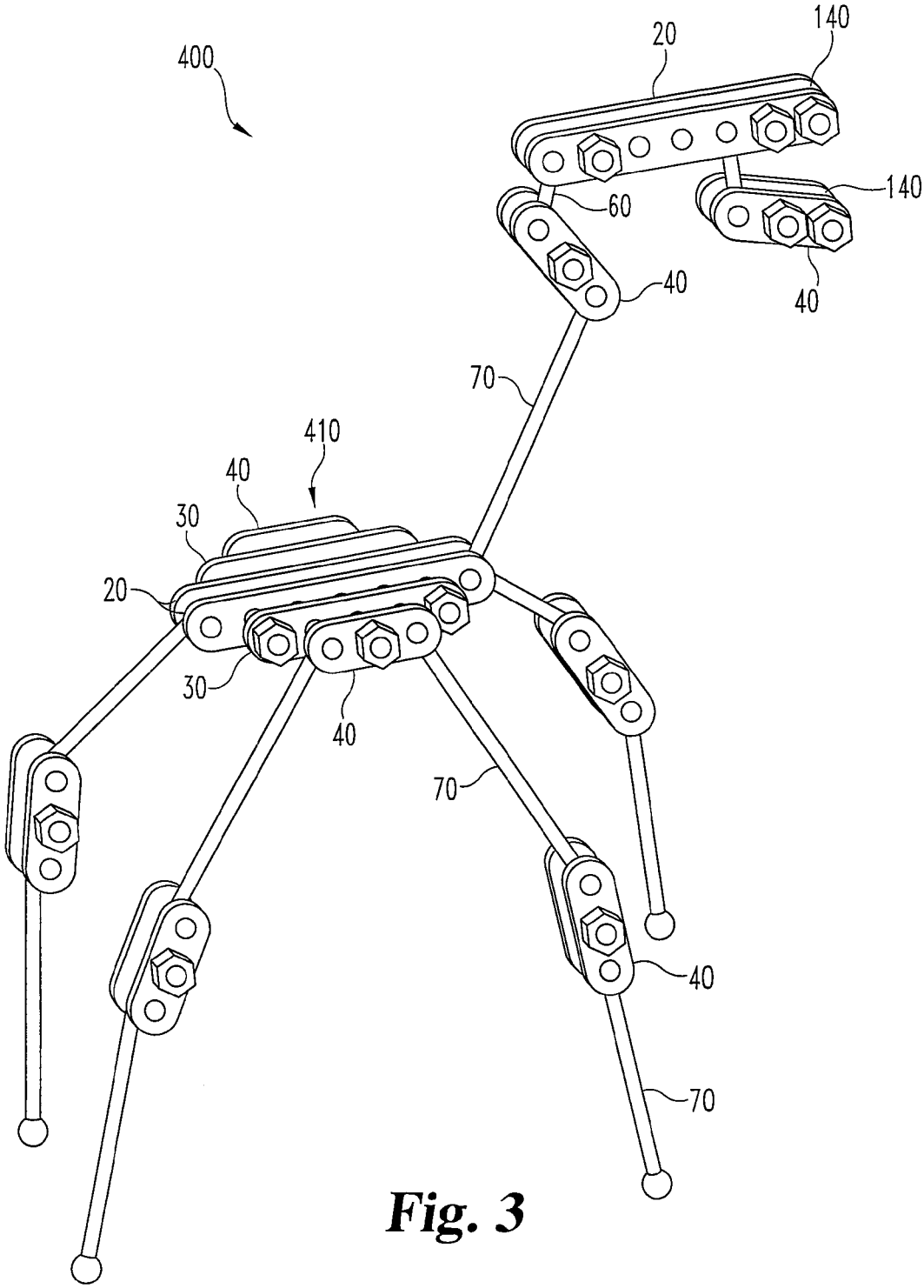
FIG. 3 depicts an armature of the invention having a quadruped form.

With reference now to FIG. 3, depicted is another preferred armature construction 400 of the invention, generally representing a four-legged or quadruped animal. The construction of many of the segments of the armature 400 is similar to that for the human-form armature discussed above in connection with FIG. 2, the details of which will thus not be repeated here. Armature 400, however, illustrates additional features of armature elements and kits of the invention, including for example the ability to stack more than two plates in a segment, and the use of cylindrical spacers.

Figure 4:
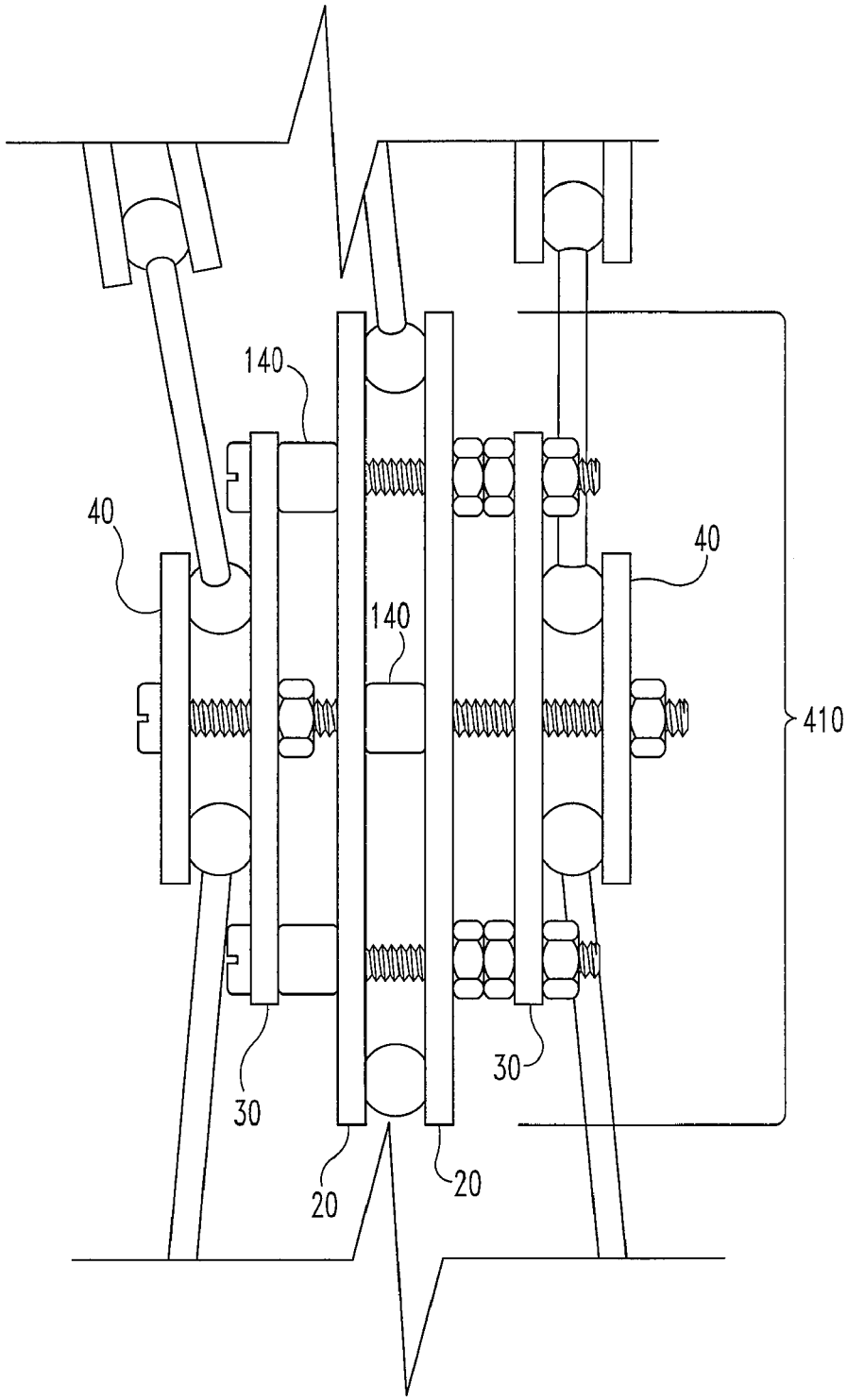
FIG. 4 provides an enlarged cutaway view of the central body portion of the armature of FIG. 3.
Figure 5A:
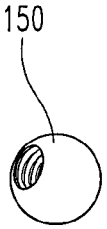
FIGS. 5A-E show an armature ball element having a threaded thru-aperture for inclusion in inventive armature kits and constructions, and illustrative uses thereof.
Figure 5B:
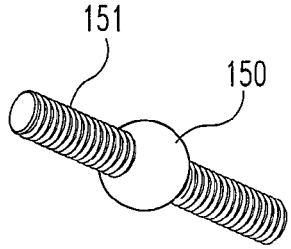
Figure 5C:
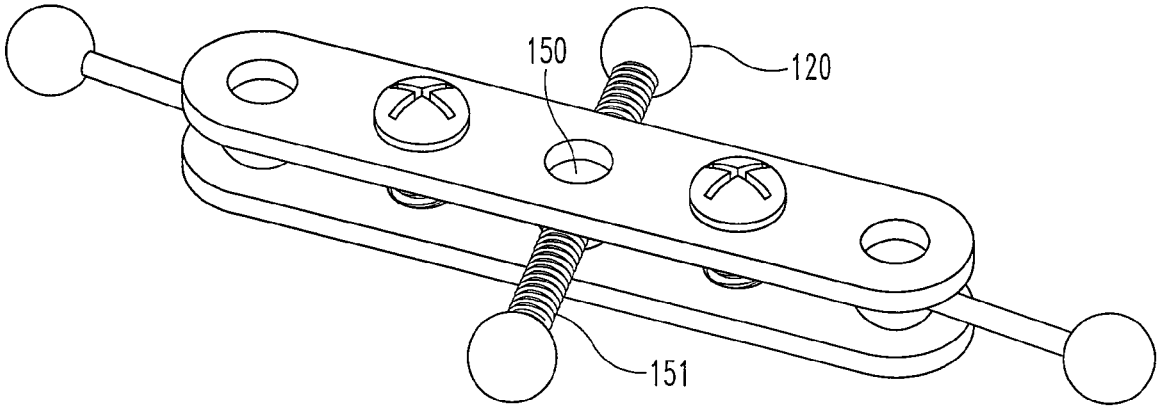
Figure 5D:
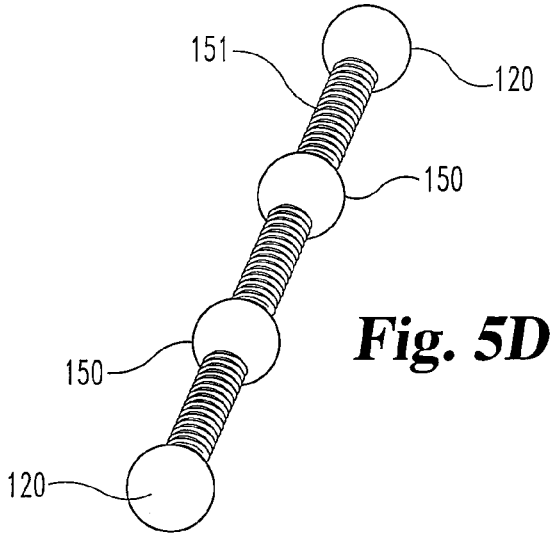
Figure 5E:
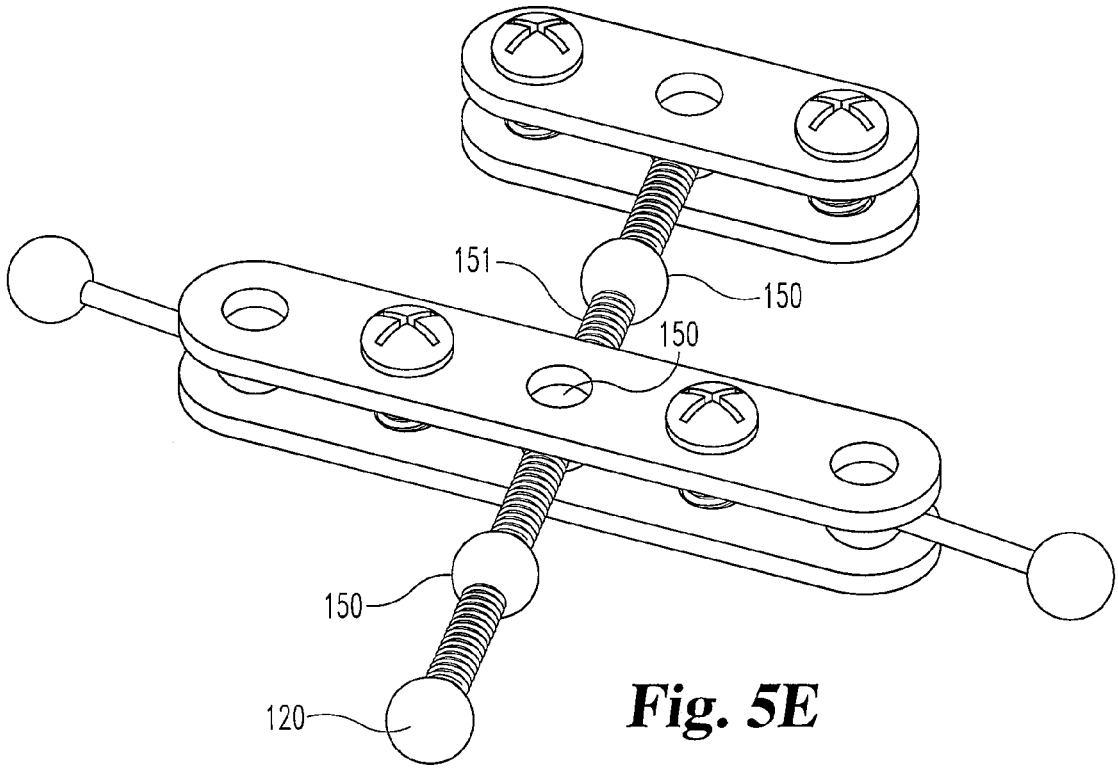

With continued reference to FIG. 3, along with FIGS. 1 and 4, the animal armature 400 includes four legs, which are formed from long dumbbell elements 70, short plates 40, and screw/nut fasteners. These legs are connected to a central body portion 410, formed of six stacked plates (see especially FIG. 4). In particular, central body portion 410 includes two long plates 20, two intermediate plates 30, and two short plates 40. A central screw passes through the aligned central apertures 23, 33, and 42 of all six plates. Cylindrical spacer elements 140 are provided for stability or joint-tensioning isolation where desired, and intermediately-positioned nuts are used as desired to provide appropriate tension to ball-and-socket joints. As can be seen, the presence of multiple interiorly-located apertures on the various plates (in addition to those serving in the ball-and-socket joints), provides the ability to laterally connect or "stack" any number of plates to create segments of varying dimension, while in many cases also providing still further available apertures to receive spacers, balls, dumbbell connectors, etc. These and other advantages of the disclosed armature kits, constructions and components will be readily apparent to persons of ordinary skill in the art.

Referring now to FIGS. 5-8, these depict additional armature components that can optionally be incorporated into inventive armature kits and constructions. For example, FIG. 5A shows a ball element 150 having a threaded thru-aperture (extending completely across the diameter of the ball). In this fashion, a threaded rod 151 (FIG. 5B) can be threaded completely through the ball element 150. Each end of the threaded rod 151 may in turn be connected to another element of the armature. This arrangement may be used, for example to allow a ball bearing to be used as a tension isolator between two dumbbell joints as well as a pass through support for a threaded rod to which are attached additional threaded ball bearings as generally illustrated in FIG. 5C. The length of the threaded rod can be varied to vary the number of threaded thru-aperture ball elements that may be utilized and expanded upon, as illustrated for example in FIGS. 5D and 5E.

Figure 6A:
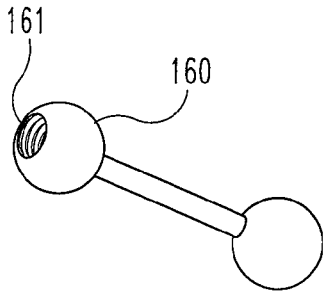
FIGS. 6A-6C show an armature dumbbell connector of the invention having a threaded, axially-extending aperture in one spherical end portion thereof, and illustrative uses thereof.
Figure 6B:
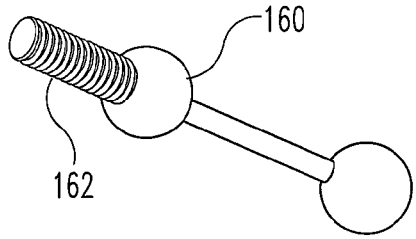
Figure 6C:
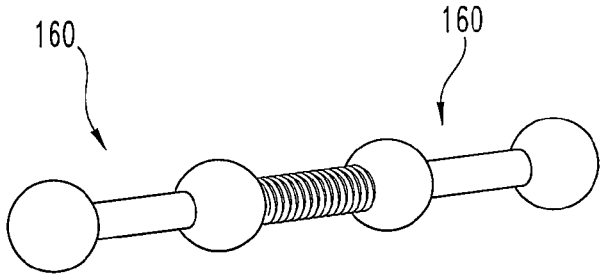
Figure 6D:
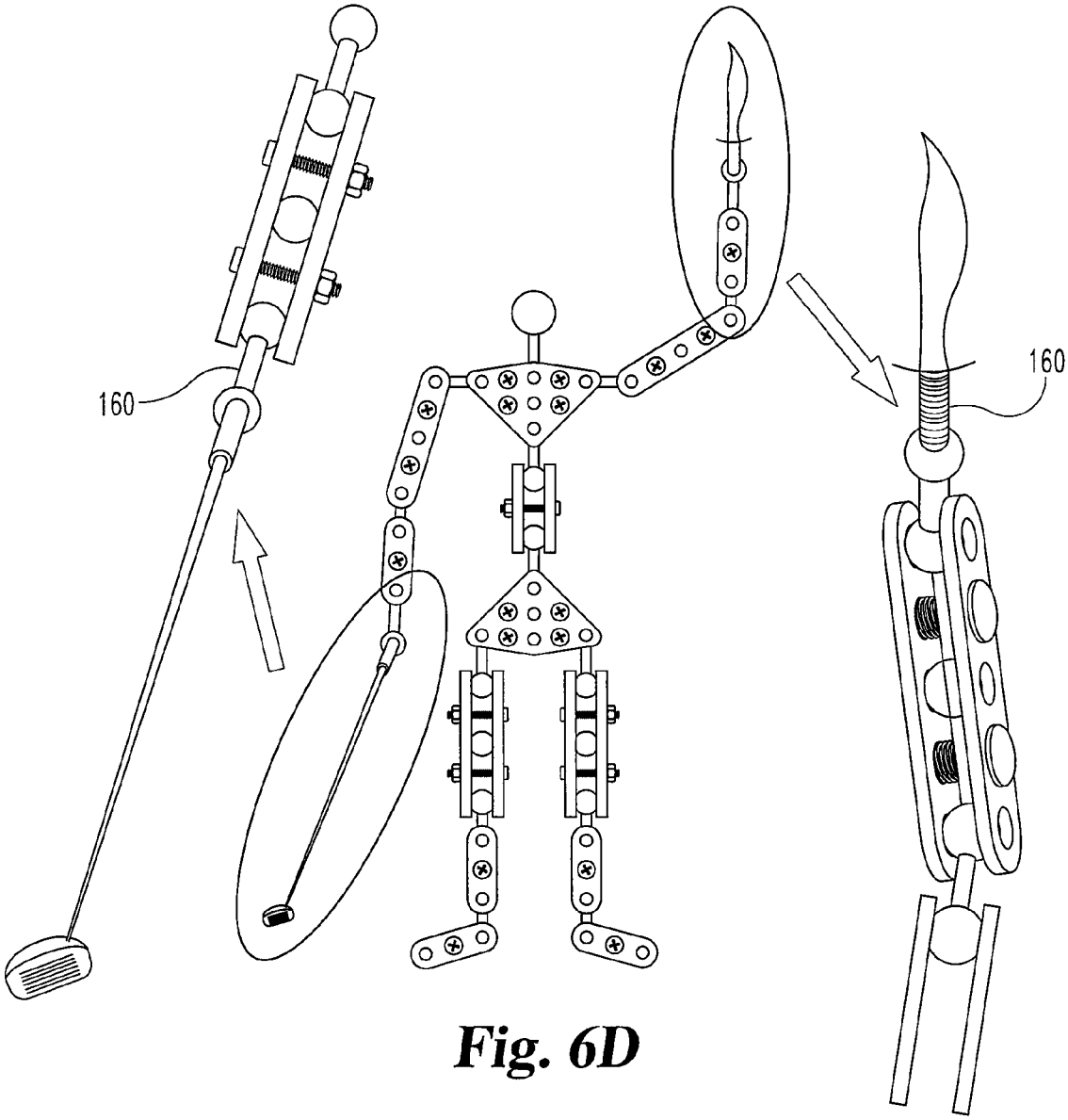

FIG. 6A depicts a dumbbell connector 160 having a threaded aperture 161 in a spherical end portion thereof, wherein the axis of the aperture is aligned with that of the connector post. In this fashion, dumbbell connector can be used in a tie-down arrangement in connection with a threaded rod 162 (see FIG. 6B), screw, or the like. In addition, dumbbell connector 160 can have other like dumbbell connectors attached in an end-to-end fashion, without having to utilize plates and thus eliminating movement and creating a rigid connection between dumbbell connectors (see FIG. 6C). Plates and joints may be added onto such connected dumbbells in any configuration desired. Dumbbell connectors 160 incorporated into creature-form armatures can also be utilized to attach character props (e.g. golf clubs, swords, etc.) that have similar threaded rod attachments, as illustrated in FIG. 6D.

Figure 7A:
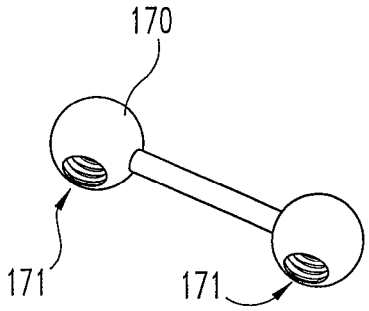
FIGS. 7A-7D show an armature dumbbell connector of the invention having threaded, perpendicularly-extending thru-apertures in its spherical end portions, and illustrative uses thereof.
Figure 7B:
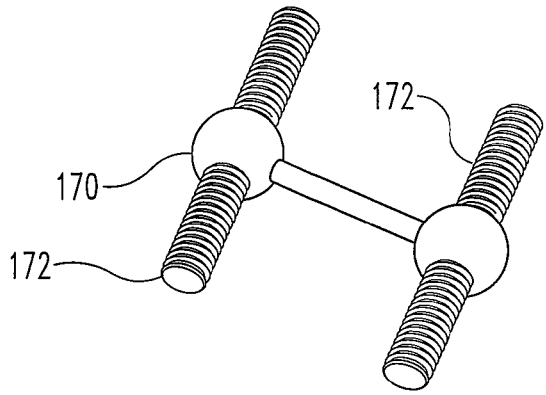
Figure 7C:
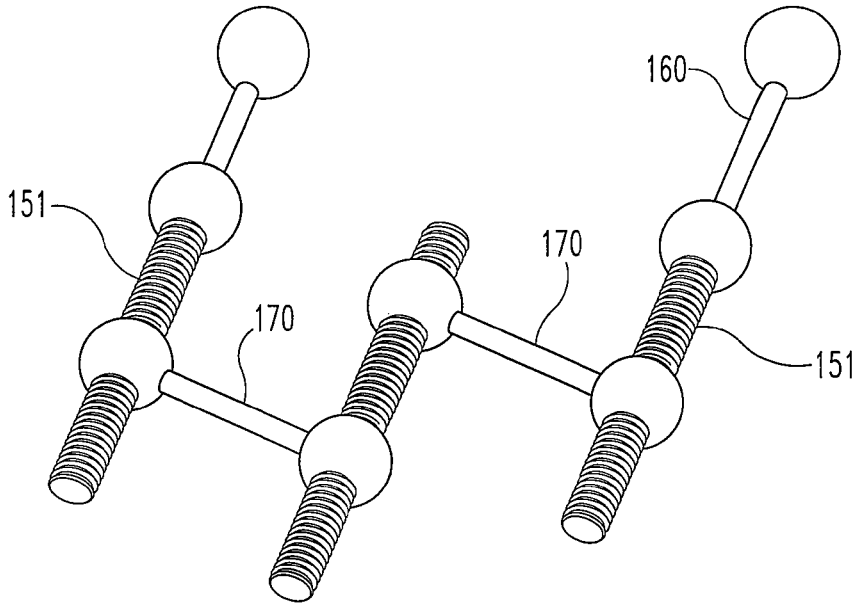
Figure 7D:
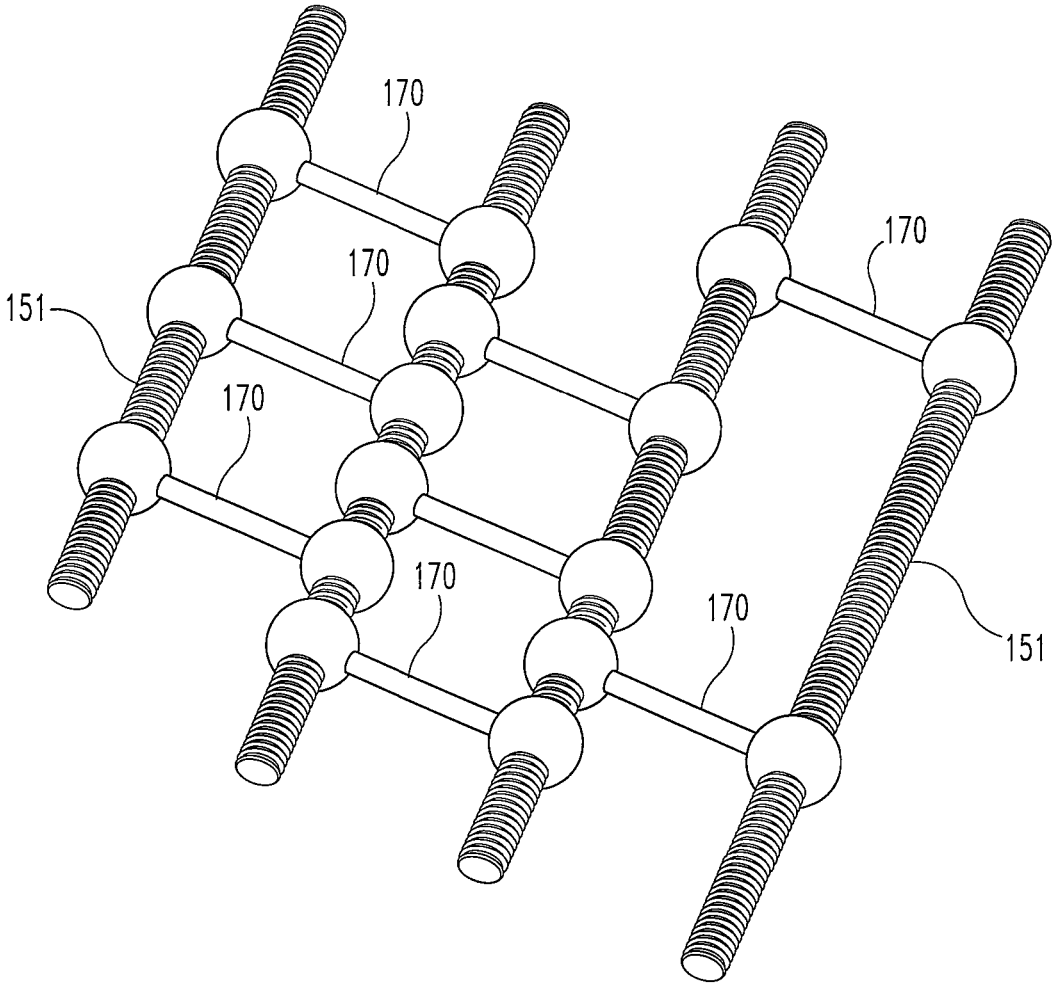

FIG. 7A depicts a dumbbell connector 170 having threaded thru-apertures 171 in each spherical end portion. The axes of the thru-apertures 171 is generally transverse to, and preferably perpendicular to, the axis of the intermediate rod or post of the dumbbell connector 170. This enables threaded receipt of threaded rods 172 (FIG. 7B) completely through the spherical end portions of dumbbell connector 170, so as to extend transversely (preferably perpendicularly) to the axis of the connector 170. This arrangement may be used, for example, to allow other dumbbell connectors to be attached rigidly and at a 90-degree angle upon which plates and joints may be added in any configuration desired, as illustrated in FIG. 7C. This arrangement may also be used to create stacked sections of dumbbell joints vertically or horizontally upon which plates and joints may be added in any configuration desired, as illustrated in FIG. 7D.

Figure 8A:
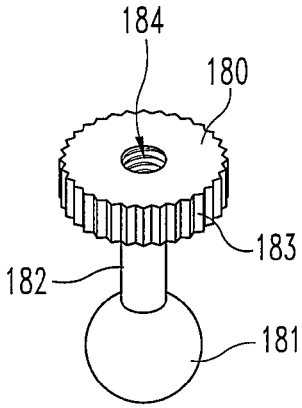
FIGS. 8A through 8D show an armature tie-down element and arrangement of the invention.
Figure 8B:
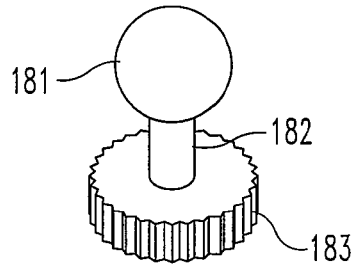
Figure 8C:
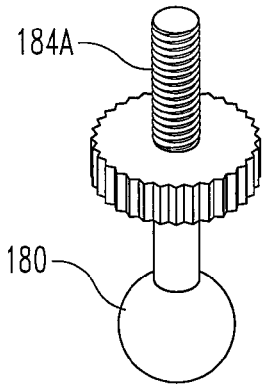
Figure 8D:
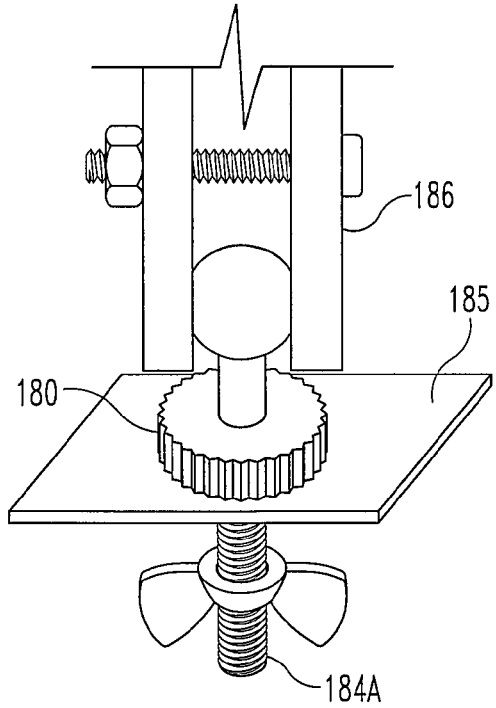

FIGS. 8A-8D depict a collared tie-down connector 180 of the invention, and its use. Tie-down connector 180 includes a generally spherical end portion 181 connected to an intermediate post portion 182, similar to dumbbell connector end portions and posts described above. Post 182 is connected at its opposite end to a generally cylindrical collar 183. Collar 183 has an outer-facing surface having a threaded aperture 184 defined therein. FIGS. 8C and 8D show connector 180 in use. A threaded rod 184A is threaded into the threaded aperture 184. This rod can be passed through a surface 185 to which an associated armature is to be attached. A nut, such as a wing nut (as shown), can be used to tighten the connector 180/rod 184 combination to the surface 185. In turn, the spherical end portion 181 of the connector 180 can be sandwiched between two plates 186 integrated within the associated armature, so as to tie the armature down to the surface 185.

It will be understood that any or all of the components depicted in FIGS. 5-8 can be included in armature kits and constructions as described hereinabove, constituting additional embodiments of the present invention.

Armature components of the invention can be made from any suitable material. Metals or plastics are advantageous, with metals, and especially steel, being preferred materials of construction.

Armatures in accordance with the invention can be covered with clay, latex, rubber, cloth or other materials to complete a character or object. Such characters or objects can, for instance, be used in stop-motion animation as articulated, posable, movable figures. Such covered or uncovered characters or objects, and their use in methods to create stop-motion animation, or in other methods, are also contemplated as a part of the present invention.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered.

What is claimed is:

1. An armature, comprising:

an armature body having a first segment including at least two plates;

said plates each defining at least two joint sockets for receiving ends of dumbbell connectors to create ball-and-socket joints; wherein the joint sockets of the respective plates form pairs laterally aligned with one another;

at least two dumbbell connectors, each having an end received within one of said pairs of joint sockets to create a ball-and-socket joint;

said plates each defining fastener-receiving apertures adjacent each socket;

said plates laterally connected to one another with fasteners positioned through said fastener-receiving apertures;

said plates each further defining an isolator socket between said fastener-receiving apertures, for receiving a joint isolation component; wherein said isolator sockets of said plates are laterally aligned with one another;

a joint isolation component received and sandwiched between the isolator sockets so as to provide isolated tensioning of said ball-and-socket joints.

2. The armature of claim 1, wherein said joint sockets and isolator sockets are apertures defined in said plates.

3. The armature of claim 1, wherein said isolation component is a ball.

4. The armature of claim 1, wherein:

said armature body includes at least a second segment attached to said first segment;

said second segment comprising a pair of diamond plates each having a generally non-equilateral deltoid shape having a wider end and a narrower end, said diamond plates each having a plurality of joint sockets defined therein, and each having at least one fastener-receiving aperture defined therein;

said pair of diamond plates laterally connected to one another by a fastener received through said fastener-receiving apertures.

5. The armature of claim 4, wherein said armature body has a human form.

6. The armature of claim 1, wherein said armature body has a quadruped animal form.

7. An armature kit, comprising:

a plurality of plates each of a first length, said plates of a first length having apertures in corresponding locations along their length, whereby the apertures are aligned when the plates are positioned laterally to one another;

a plurality of plates each of a second length differing from said first length, said plates of a second length having apertures in corresponding locations along their length, whereby the apertures are aligned when the plates are positioned laterally to one another;

a plurality of dumbbell connectors of a first length, said connectors having a first spherical element, a second spherical element, and an intermediate post connecting said first and second spherical elements;

a plurality of dumbbell connectors of a second length, said connectors having a first spherical element, a second spherical element, and an intermediate portion connecting said first and said second spherical elements;

a plurality of, ball elements having substantially the same diameter as said spherical elements;

a plurality of fasteners; and a plurality of diamond plates, said diamond plates having a generally non-equilateral deltoid shape having a wider end and a narrower end, said diamond plates having a plurality of apertures defined therein.

8. The armature kit of claim 7, wherein at least one of said dumbbell connectors has a threaded aperture in a spherical element thereof.

9. The armature kit of claim 8, wherein said threaded aperture of said dumbbell connector has a central axis substantially aligned with a central axis of the intermediate portion of the dumbbell connector.

10. The armature kit of claim 8, wherein said threaded aperture of said dumbbell connector has a central axis substantially transverse to a central axis of the intermediate portion of the dumbbell connector.

11. The armature kit of claim 10, wherein said central axis of said threaded aperture is substantially perpendicular to the central axis of the intermediate portion.

12. The armature kit of claim 7, wherein said plates of a first length each include:

two joint apertures for use in forming ball-and-socket joints, said joint apertures located adjacent opposite ends of said plates of a first length;

two fastener apertures for receiving fasteners;

at least one isolator aperture for receiving an isolator component, said isolator aperture located between said fastener apertures.

13. An armature kit, comprising at least the following components:

(a) a plurality of first plates each of a first length, said first plates each defining apertures in corresponding locations along their length, whereby the apertures are aligned when the plates are positioned laterally to one another, said apertures in each first plate including:

two joint apertures for use in forming ball-and-socket joints, said joint apertures located adjacent opposite ends of said first plate;

two fastener apertures for receiving fasteners; and at least one isolator aperture for receiving an isolator component, said isolator aperture located between said fastener apertures;

(b) a plurality of first dumbbell connectors having ends receivable in said joint apertures to form ball-and-socket joints;

(c) a plurality of fasteners receivable in said fastener apertures; and (d) a least one isolator component receivable in said isolator aperture.

14. The armature kit of claim 13, also including:

a plurality of second plates each of a second length differing from said first length, said second plates having apertures in corresponding locations along their length, whereby the apertures are aligned when the second plates are positioned laterally to one another.

15. The armature kit of claim 13, also including:

at least one dumbbell connector having a first spherical element, a second spherical element, and an intermediate portion connecting said first and said second spherical elements, said at least one dumbbell connector also including a threaded aperture in at least one of said spherical elements.

16. The armature kit of claim 13, also including:

at least one dumbbell connector having spherical end portions, and threaded thru-apertures in each spherical end portion.

17. The armature kit of claim 13, also including:

at least one tie-down connector, said tie-down connector including a generally spherical end portion, a collar, and an intermediate portion connecting said end portion and said collar; and said collar having a threaded aperture defined therein.

18. The armature kit of claim 13, also including:

at least one ball element having a threaded thru-aperture.

19. The armature kit of claim 13, also including:

a plurality of diamond plates, said diamond plates having a generally non-equilateral deltoid shape having a wider end and a narrower end, said diamond plates having a plurality of apertures defined therein.

20. The armature kit of claim 13, also including:

a plurality of cylindrical spacer elements, said fasteners receivable through said cylindrical spacer elements.

21. The armature kit of claim 13, also including:

(e) a plurality of second plates each of a second length differing from said first length, said second plates having apertures in corresponding locations along their length, whereby the apertures are aligned when the second plates are positioned laterally to one another;

(f) a plurality of second dumbbell connectors, said second dumbbell connectors having a length differing from that of said first dumbbell connectors;

(g) a plurality of diamond plates, said diamond plates having a generally non-equilateral deltoid shape having a wider end and a narrower end, said diamond plates having a plurality of apertures defined therein; and (h) a plurality of ball elements.

* * * * *